US009499297B2

(12) United States Patent
Bentley et al.

(10) Patent No.: US 9,499,297 B2
(45) Date of Patent: Nov. 22, 2016

(54) CARTON BLANK, CARTON AND CONTAINER PACKAGE

(71) Applicants: Mott's LLP, Plano, TX (US); The C.W. Zumbiel Company, Hebron, KY (US)

(72) Inventors: Darrell Bentley, Dallas, TX (US); Raymond L. Zacher, West Chester, OH (US)

(73) Assignees: Mott's LLP, Plano, TX (US); The C.W. Zumbiel Company, Hebron, KY (US)

( * ) Notice: Subject to any disclaimer, the term of this patent is extended or adjusted under 35 U.S.C. 154(b) by 7 days.

(21) Appl. No.: 14/445,155

(22) Filed: Jul. 29, 2014

(65) Prior Publication Data

US 2016/0031591 A1 Feb. 4, 2016

(51) Int. Cl.
*B65D 5/72* (2006.01)
*B65D 71/36* (2006.01)

(52) U.S. Cl.
CPC ..... *B65D 5/725* (2013.01); *B65D 71/36* (2013.01); *B65D 2571/0066* (2013.01); *B65D 2571/00141* (2013.01); *B65D 2571/00561* (2013.01); *B65D 2571/00728* (2013.01); *B65D 2571/00845* (2013.01)

(58) Field of Classification Search
CPC ..... B65D 5/725; B65D 71/36; B65D 2571/0058; B65D 2571/00574
USPC ..... 229/122.1, 242, 122, 240; 221/33, 303, 221/194; 206/427, 532, 746; D6/515; D7/589
See application file for complete search history.

(56) References Cited

U.S. PATENT DOCUMENTS 2,299,027 A * 10/1942 Novak ..... B65D 5/725 206/738
3,265,283 A * 8/1966 Farquhar ..... B65D 71/36 206/427
3,356,279 A * 12/1967 Root ..... B65D 71/36 206/427
4,043,503 A 8/1977 Meyers et al.
4,416,369 A * 11/1983 Burns ..... B65D 5/4208 206/45.28
4,498,581 A * 2/1985 Dutcher ..... B65D 71/36 206/427
5,505,372 A 4/1996 Edson et al.
5,622,309 A 4/1997 Matsuda et al.
6,209,786 B1 4/2001 Yelton et al.
6,464,132 B1 * 10/2002 Duquet ..... B65D 5/16 206/532
6,866,186 B2 3/2005 Fogle et al.
7,134,551 B2 11/2006 Harrelson
7,337,942 B2 3/2008 Wang
(Continued)

OTHER PUBLICATIONS

Capri Sun, Capri Sun Carton, Photographs, May 2014, 3 pgs.
(Continued)

*Primary Examiner* — Christopher Demeree
(74) *Attorney, Agent, or Firm* — Wood Herron & Evans LLP

(57) ABSTRACT

A package of multiple containers in a carton formed from a carton blank has a number of panels including a top panel, a bottom panel, opposed side panels and opposed end panels. The carton may include a dispenser defined by a dispenser tear line formed in one or more panels of the carton in which the dispenser tear line does not extend into the composite end panels nor does it remove corners from the panels. The dispenser may include a portion in the top panel of the carton and may also include a portion of the top panel and an adjacent side panel of the carton. In one aspect, the dispenser leaves the adjacent corners in the top panel of the carton intact thereby maintaining the structural integrity of the carton and the package containing the pouches or other containers.

47 Claims, 18 Drawing Sheets

(56) References Cited

U.S. PATENT DOCUMENTS

| | | | | |
|---|---|---|---|---|
| 7,703,665 | B2 * | 4/2010 | McGowan | B65D 5/722 221/302 |
| 7,815,097 | B2 | 10/2010 | Fogle et al. | |
| 8,087,570 | B2 | 1/2012 | Ho Fung | |
| 2007/0295792 | A1 | 12/2007 | Zammit et al. | |

OTHER PUBLICATIONS

International Searching Authority, Notification of Transmittal of the International Search Report and the Written Opinion of the International Searching Authority, or the Declaration, PCT/US2015/41481, 13 pgs., Dec. 1, 2015.

* cited by examiner

CARTON BLANK, CARTON AND CONTAINER PACKAGE

BACKGROUND OF THE INVENTION

This invention relates to cartons which may be used for storing or shipping a plurality of products and converted to an open container suitable to display and dispense the products individually. More particularly, this invention relates to an enclosed paperboard carton capable of enclosing containers, which carton has a unique opening and dispensing feature that allows the containers, for example, pouches to be removed or dispensed without destroying the overall structural integrity of the carton. The unique opening and dispensing feature can be incorporated in cartons containing a plurality of layers of pouches stacked on their sides.

Pouches made out of various materials have become popular for carrying drinks and other consumer food items such as applesauce. Cardboard cartons are generally used to package and ship a plurality of individually wrapped or packaged articles such as consumer products.

A number of these pouches can be carried in a carton, but the removal of a portion of the carton to remove a pouch results in the destruction of the carton. The destruction of the carton often results from tearing open the dispenser and by doing so also weakening the composite end panel of the carton which is formed by gluing multiple flaps together. The dispenser tear lines typically run through the glued flaps and the integrity of the composite end panel is destroyed or compromised by tearing the dispenser. It would be convenient and desirable for these cartons to have a readily openable or removable panel that would allow access to the contents of a carton without destroying the carton.

It would also be desirable to have a carton that could dispense these pouches, but yet remain intact for future dispensing, containment or carrying.

SUMMARY OF THE INVENTION

These and other shortcomings in the prior art have been addressed by this invention which in various embodiments includes a package of multiple containers, a carton for the containers and a blank for forming the carton.

In one embodiment, the package according to this invention includes a carton containing multiple pouches for drinks, consumer food items, applesauce or other items. The carton has a number of panels including a top panel, a bottom panel, opposed side panels and opposed end panels. The end panels may be formed from overlapping end flaps extending from various side, top and bottom panels of the carton. The carton may include a dispenser defined by a dispenser tear line formed in one or more panels of the carton.

One aspect of various embodiments of this invention is that the dispenser tear line does not extend into the composite end panels nor does it remove corners from the panels. In various embodiments, dispensers of this invention may include a portion in the top panel of the carton and may also include a portion of an adjacent side panel of the carton. In one aspect, the dispenser leaves the adjacent corners in the top panel of the carton intact thereby maintaining the structural integrity of the carton and the package containing the pouches or other containers. In another aspect of this invention, the dispenser does not include any corner of a panel in which the dispenser is formed.

The pouches are arranged in layers stacked on their sides with the longitudinal axis of each package being oriented generally parallel to the end, top and bottom panels of the carton. With the containers in this configuration and orientation within the carton, removal of the dispenser according to various embodiments of this invention allows for the convenient and easy removal of the pouches through the top panel and from the carton without the uncontrolled or inadvertent tumbling or spilling of the pouches from the carton once the dispenser is opened. Moreover, the orientation and configuration of the pouches within the carton and the design of the dispenser allows for the attractive and convenient presentation of the pouches to a user or consumer without the pouches to falling or discharging inadvertently from the carton.

Moreover, various embodiments of this invention also include a viewing port or window in the carton to allow for viewing of the pouches within the carton prior to removal of the dispenser from the carton.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
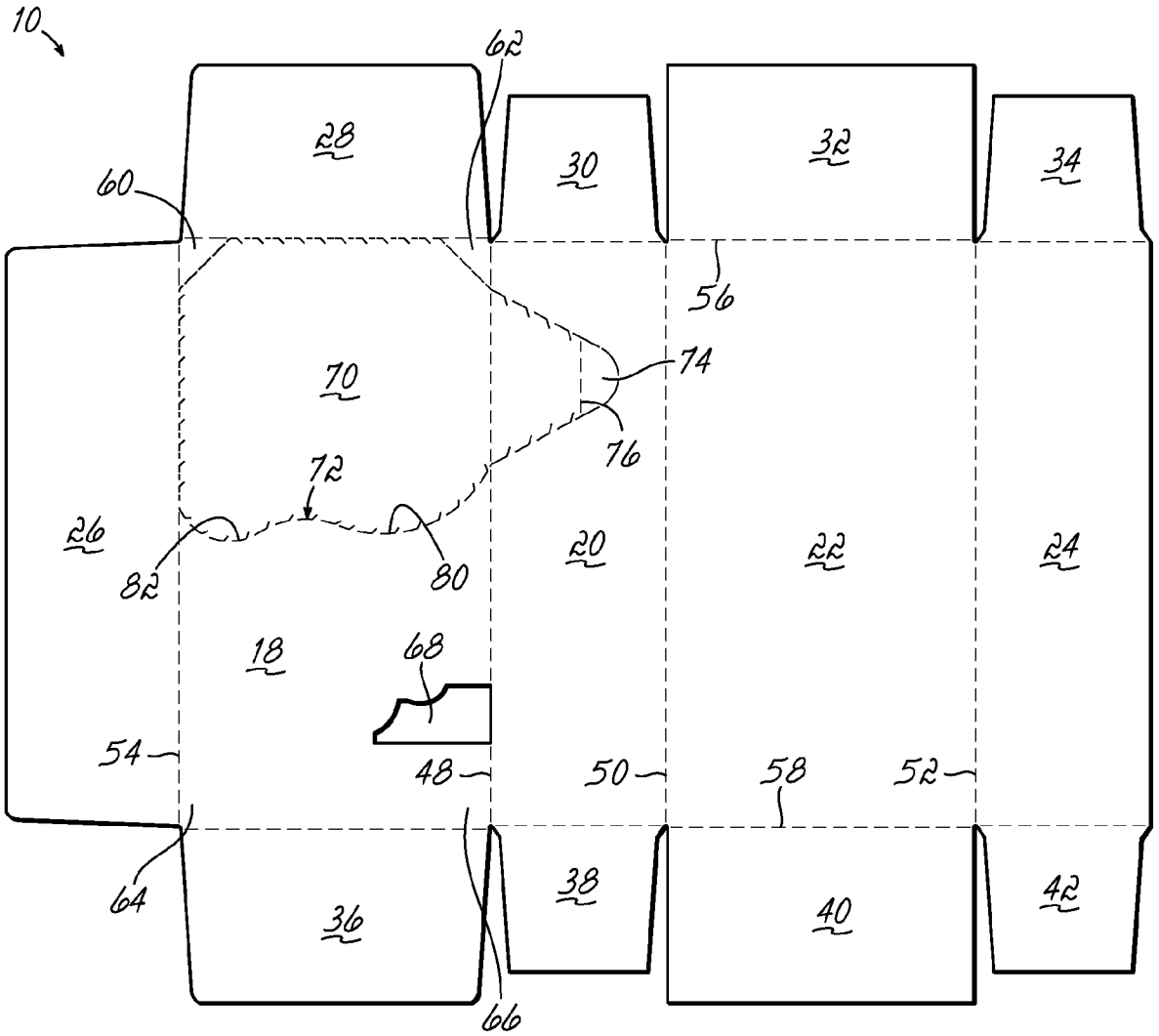
FIG. 1 is a top plan view of one embodiment of a carton blank according to this invention.
Figure 3:
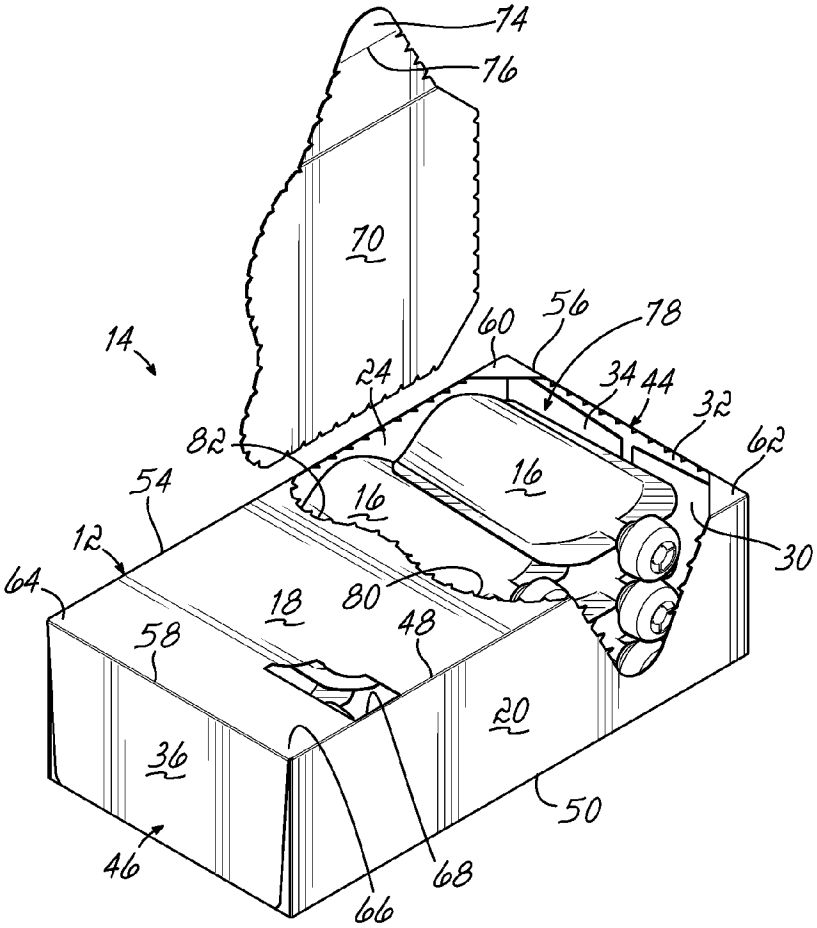
FIGS. 2-4 are perspective and sequential views of a package according to one embodiment of this invention in which a dispenser on a carton formed from the blank of FIG. 1 is removed from the carton for removal of one or more pouches from the carton.
Figure 2:
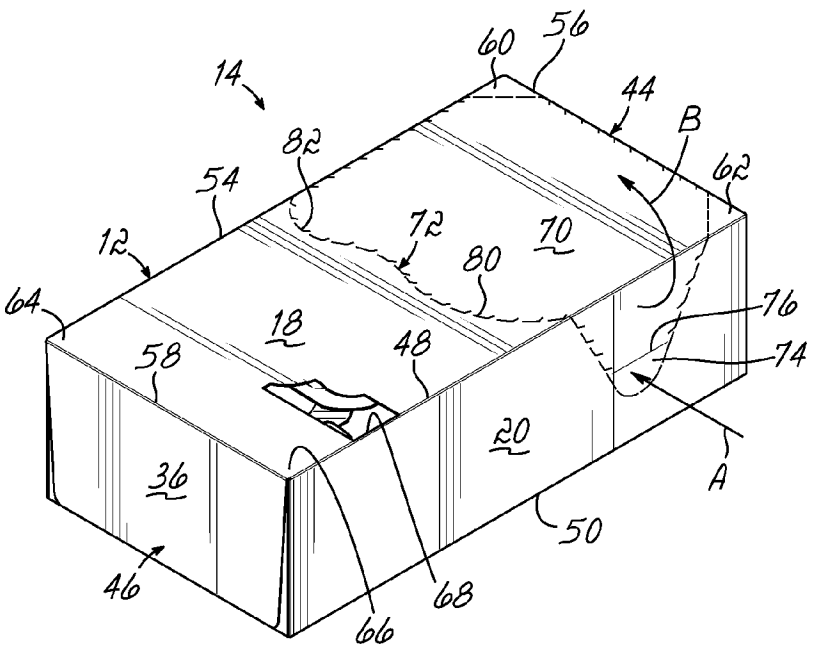

Referring to FIG. 1, one embodiment of a carton blank 10 used to form a carton 12 (FIG. 2) as part of a package 14 (FIG. 3) containing a number of containers 16 (FIGS. 3-5) according to this invention is shown. The carton blank 10 includes serially connected panels including a top panel 18, side panel 20, bottom panel 22 and side panel 24. Opposite from the side panel 20 and connected to the top panel 18 is a flap 26 which is utilized to form the carton blank 10 into a clam shell configuration by gluing or otherwise attaching the flap 26 to the opposite side panel 24 according to one embodiment of this invention.

The carton blank 10 also includes a number of end flaps 28, 30, 32, 34, 36, 38, 40, 42 each attached to a longitudinal end of one of the panels 18, 20, 22, 24 as shown in FIG. 1. The end flaps 28, 30, 32, 34 at one end of the carton 10 blank combine to form a composite end panel 44 when the carton blank 10 is erected into the carton 12. Similarly, the end flaps 36, 38, 40, 42 at an opposite longitudinal end of the carton blank 10 combine to form a composite end panel 46 at an opposite end of the erected carton 12. The serially joined panels 18, 20, 22, 24 of the carton blank 10 of FIG. 1 are joined together by fold lines 48, 50, 52 and an additional fold line 54 is also provided between the flap 26 and the top panel 18. A pair of laterally extending fold lines 56, 58 extends at the longitudinal ends of the respective panels to join the associated end flaps 28, 30, 32, 34, 36, 38, 40, 42 to the respective panel 18, 20, 22, 24. Top panel corners 60, 62, 64, 66 are formed in the top panel 18 adjacent to the respective fold lines as shown in FIG. 1. Similarly, corners are formed in each of the side panels 20, 24 adjacent to either of the end panels 44, 46 and the top or bottom panels 18, 22. The carton blank 10 may be constructed of 0.020 inch thick clay coated news back (CCNB) according to one embodiment.

The carton blank 10 of FIG. 1 also includes a viewing window 68 in the top panel 18 through which the contents of the package 14 in the carton 12 erected from the carton blank 10 may be viewed without opening the carton 12. The shape and configuration of the viewing window 68 according to one embodiment is shown in FIG. 1 and it should be appreciated by those of ordinary skill in the art that the shape, configuration and location of the viewing window 68 may be varied according to the requirements of the package 14 including any graphics or other material printed on the package 14 to be compatible with the viewing window 68.

A dispenser 70 is also formed in the carton blank 10 of FIG. 1 and is defined at least in part by a dispenser tear line 72. The dispenser 70 and associated tear line 72 of the blank 10 of FIG. 1 is limited to the top panel 18 and adjacent side panel 20. The dispenser 70 does not extend into either end panel 44, 46. Moreover, a portion of the dispenser tear line 72 extends along the juncture between the top panel 18 and the end flap 28 coincident with the fold line 56. Additionally, another portion of the dispenser tear line 72 extends along the juncture between the top panel 18 and the flap 26 coincident with the fold line 54.

According to one aspect of this invention, the dispenser 70 and associated fold line 72 does not include the two adjacent corners 60, 62 of the top panel 18 as shown in FIG. 1 such that when the dispenser 70 is removed along the dispenser tear line 72 from the erected carton 12, structural integrity of the carton 12 remains intact due in part to the presence of the top panel corners 60, 62 remaining after the dispenser 70 is removed. The dispenser 70 does not include any corner of any panel in which the dispenser is formed. A finger flap 74 may be included with the dispenser 70 to provide a pull tab or other structure. The finger flap 74 is joined to the remainder of the dispenser 70 via a finger flap fold line 76 such that a user may puncture the finger flap 74 from the side panel 20 of the carton 12 (arrow A, FIG. 2) and thereby grasp the finger flap 74 to pull the dispenser 70 from the carton 12 (arrow B) while tearing along the dispenser tear line 72. Once the dispenser 70 is removed from the carton 12, a dispenser opening 78 (FIG. 3) is formed in the package 14 through which the containers 16 may be conveniently removed (arrow C, FIG. 4) from the remaining erected carton 12 which retains structural integrity and configuration similar to that shown in FIGS. 3-4.

The dispenser 70 according to the configuration shown in FIGS. 1-4 may include a pair of lobes 80, 82 in the top panel 18 defined at least in part by a sinuous portion of the dispenser tear line 72.

Figure 4:
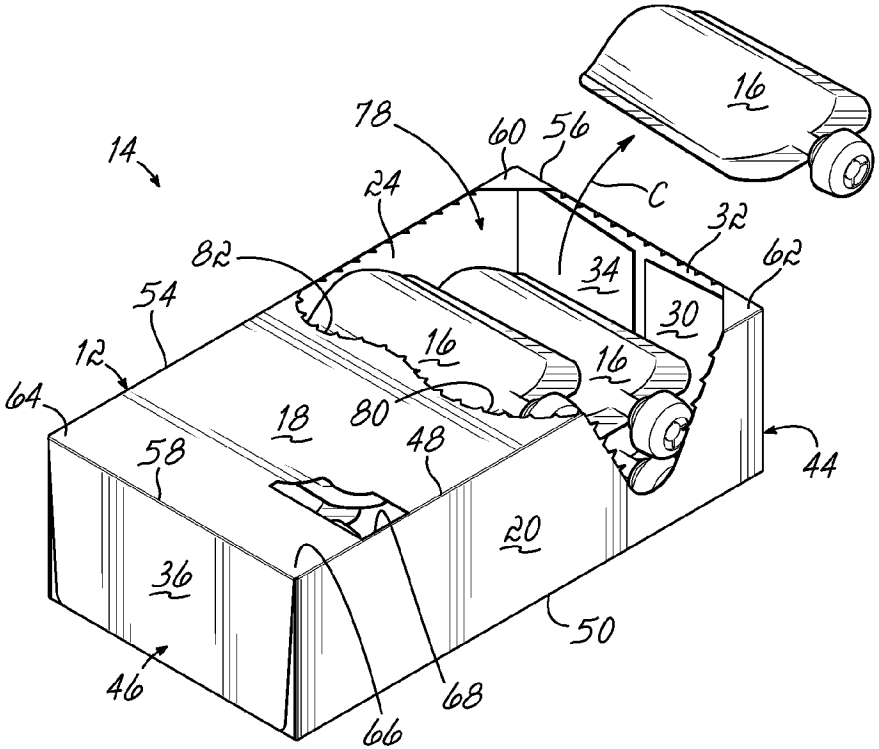

Removal of the containers 16 through the dispenser opening 78 is possible through the top panel 18 of the package 14 as shown in FIG. 4. Each container 16 may be conveniently grasped by a user for removal through the dispenser opening 78 including a portion accessible via the top panel 18 or the side panel 20 as shown in FIG. 4. Advantageously, the remaining containers 16 remain securely within the carton 12 after removal of the dispenser 70 and do not fall or tumble uncontrollably from the carton 12 even though the dispenser opening 78 is exposed.

Figure 5:
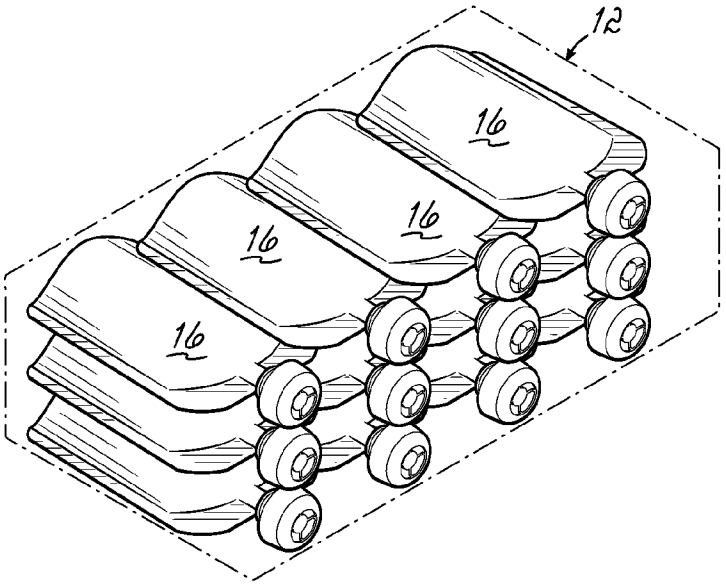
FIG. 5 is a perspective view showing an arrangement according to one aspect of this invention of the pouches within the carton of FIGS. 2-4.

In one embodiment of this invention, the carton 12 erected from the carton blank 10 may be utilized to contain a number of containers 16 in the form of pouches. Each pouch 16 has a longitudinal axis and these axes are similarly oriented within the carton 12 as shown in FIG. 5. The pouches 16 may be layered and the orientation of the pouches in successive layers may alternate cap to bottom gusset. In other configurations according to this invention, the orientation of the pouches 16 from layer to layer may be the same, 90° offset, 180° offset or another arrangement. In one configuration, the carton 12 according to various aspects of this invention may be sized and configured to contain twelve similarly oriented pouches 16 as shown in FIG. 5. Each pouch 16 may contain a drink or other consumable item such as applesauce, yogurt or the like. As shown in FIG. 1-4, the viewing window 68 in the blank 10, carton 12, and package 14 according to various embodiments of this invention may be spaced from the dispenser opening 78 and located along the juncture between the top panel 18 and adjacent side panel 20. A diagonal portion of the dispenser tear line 72 is adjacent each corner as shown in FIG. 1 thereby directing the tearing of the dispenser 70 from the package 14 so that the associated top panel corner 60, 62 remains on the package 14.

Figure 6:
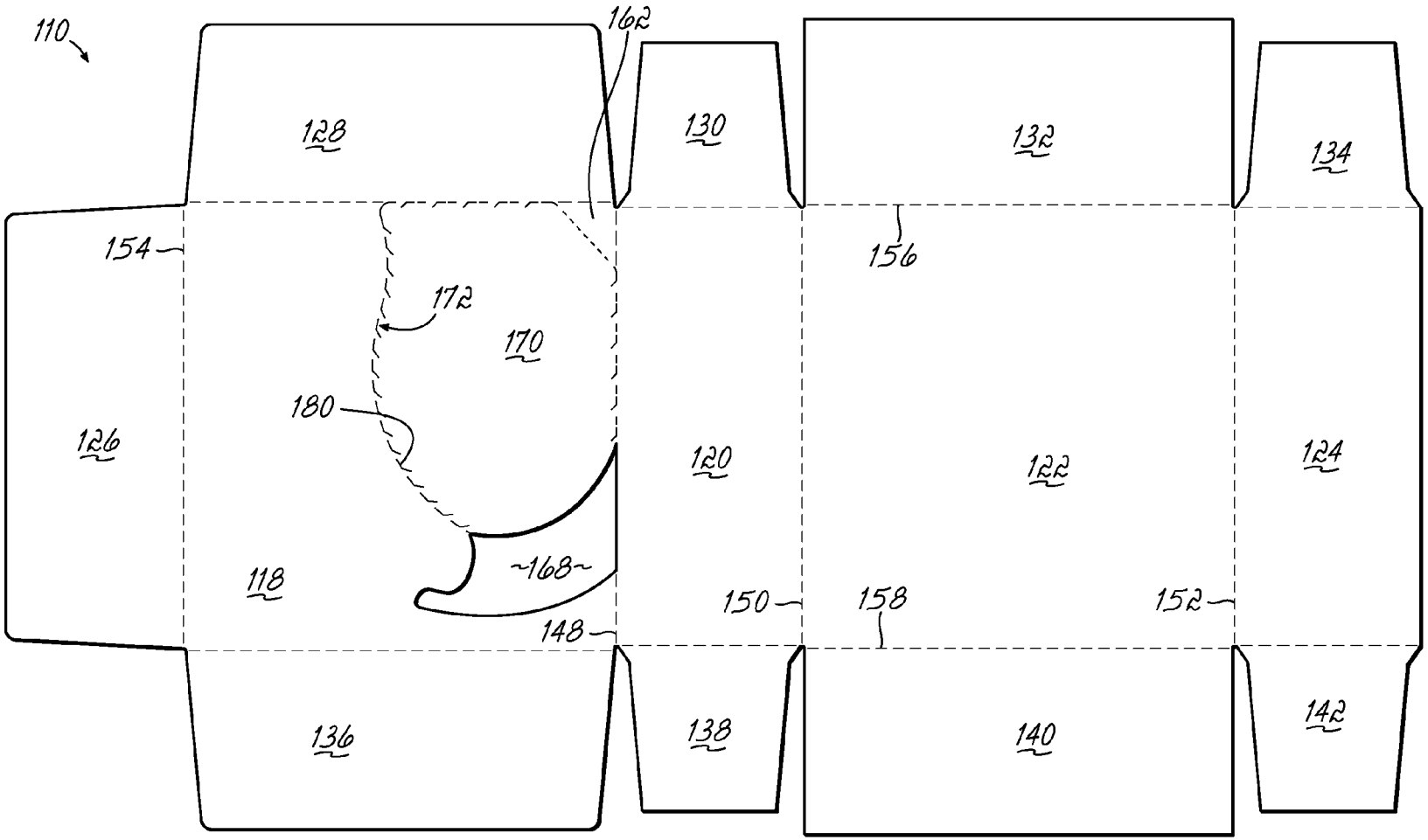
FIG. 6 is a top plan view of another embodiment of a carton blank according to this invention.
Figure 8:
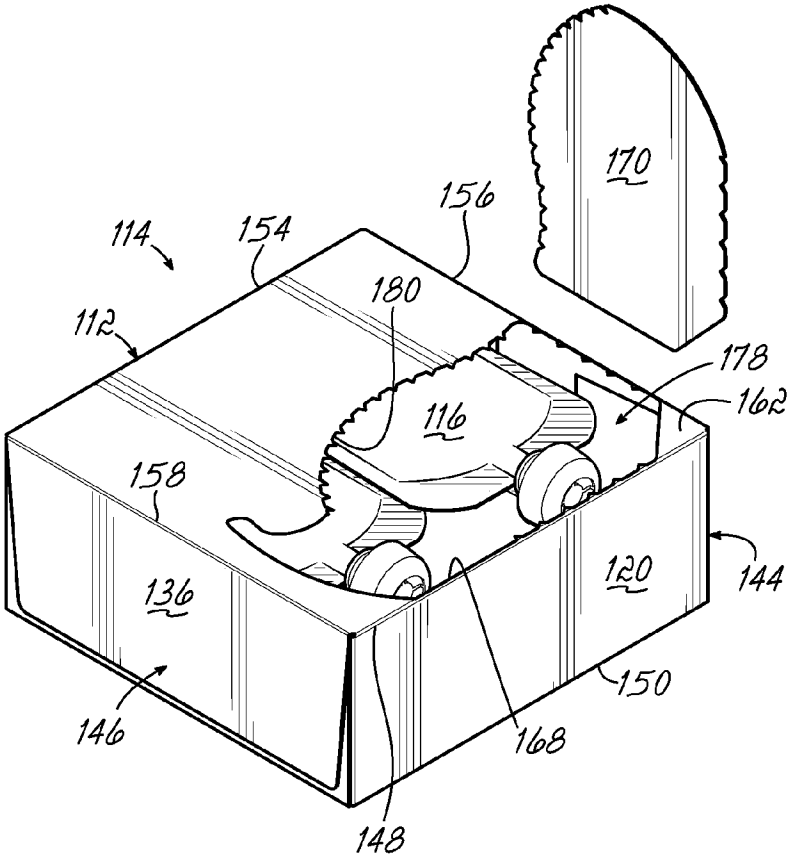
FIGS. 7-9 are perspective and sequential views of a package according to another embodiment of this invention in which a dispenser on a carton formed from the blank of FIG. 6 carton dispenser on a carton is removed from the carton for removal of one or more pouches from the carton.
Figure 7:
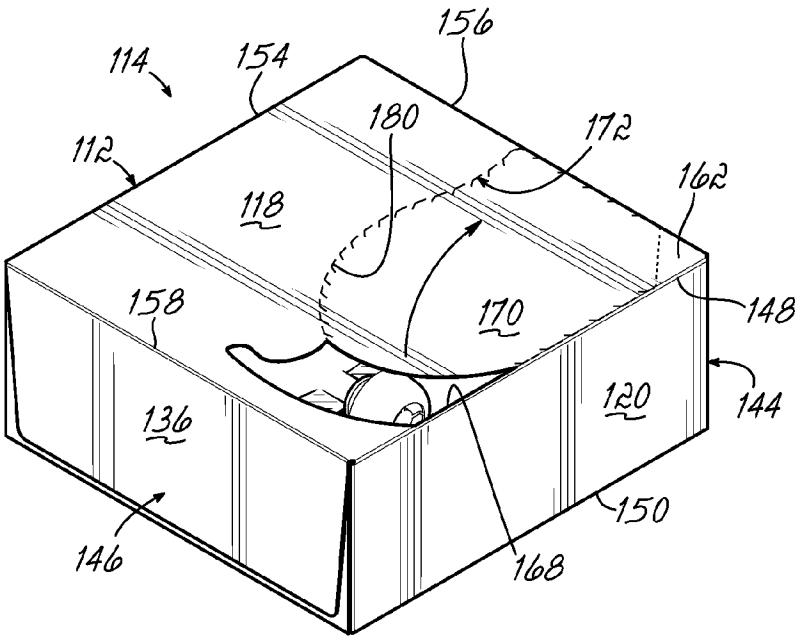
Figure 10:
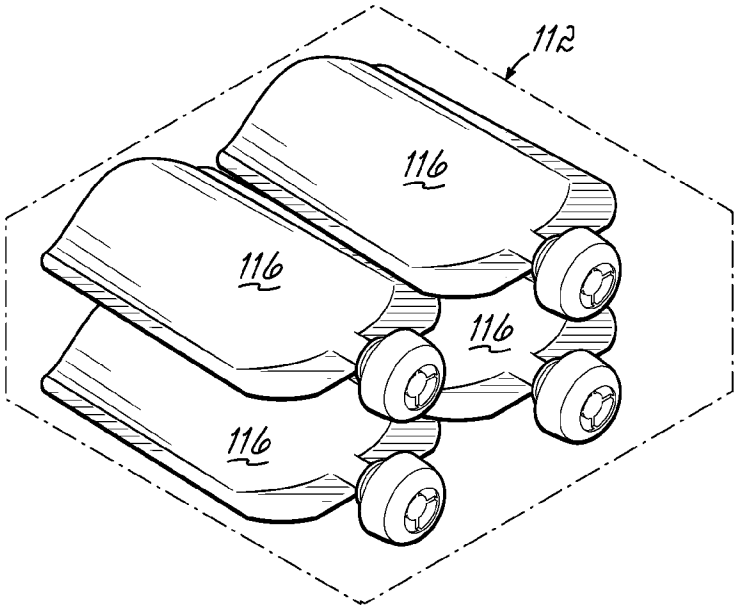
FIG. 10 is a perspective view showing an arrangement according to one aspect of this invention of the pouches within the carton of FIGS. 7-9.
Figure 9:
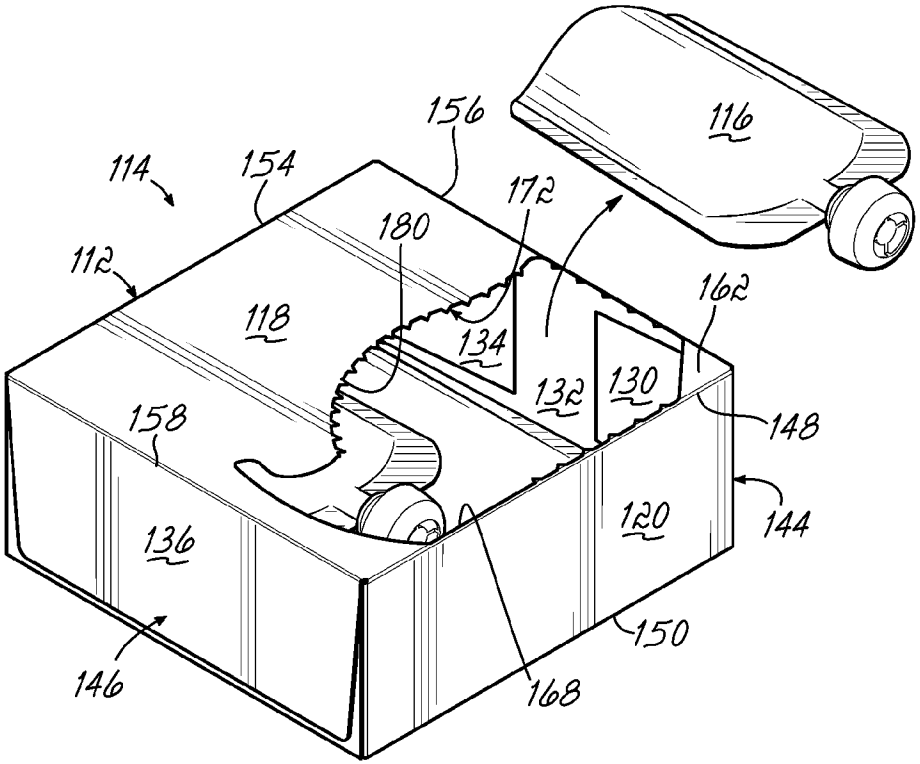
Figure 11:
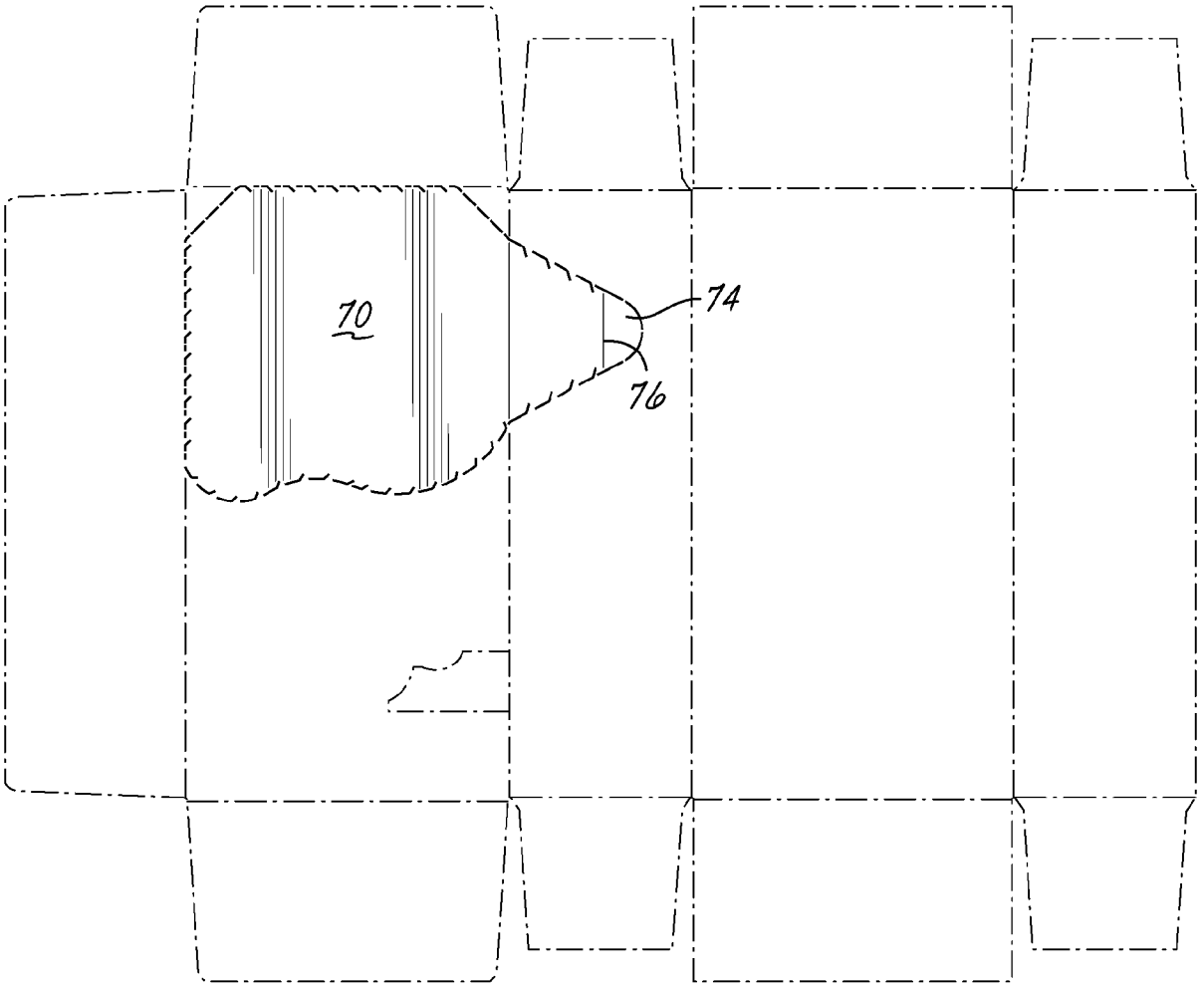
FIG. 11 is a top plan view of a dispenser flap according to another embodiment of this invention.
Figure 12:
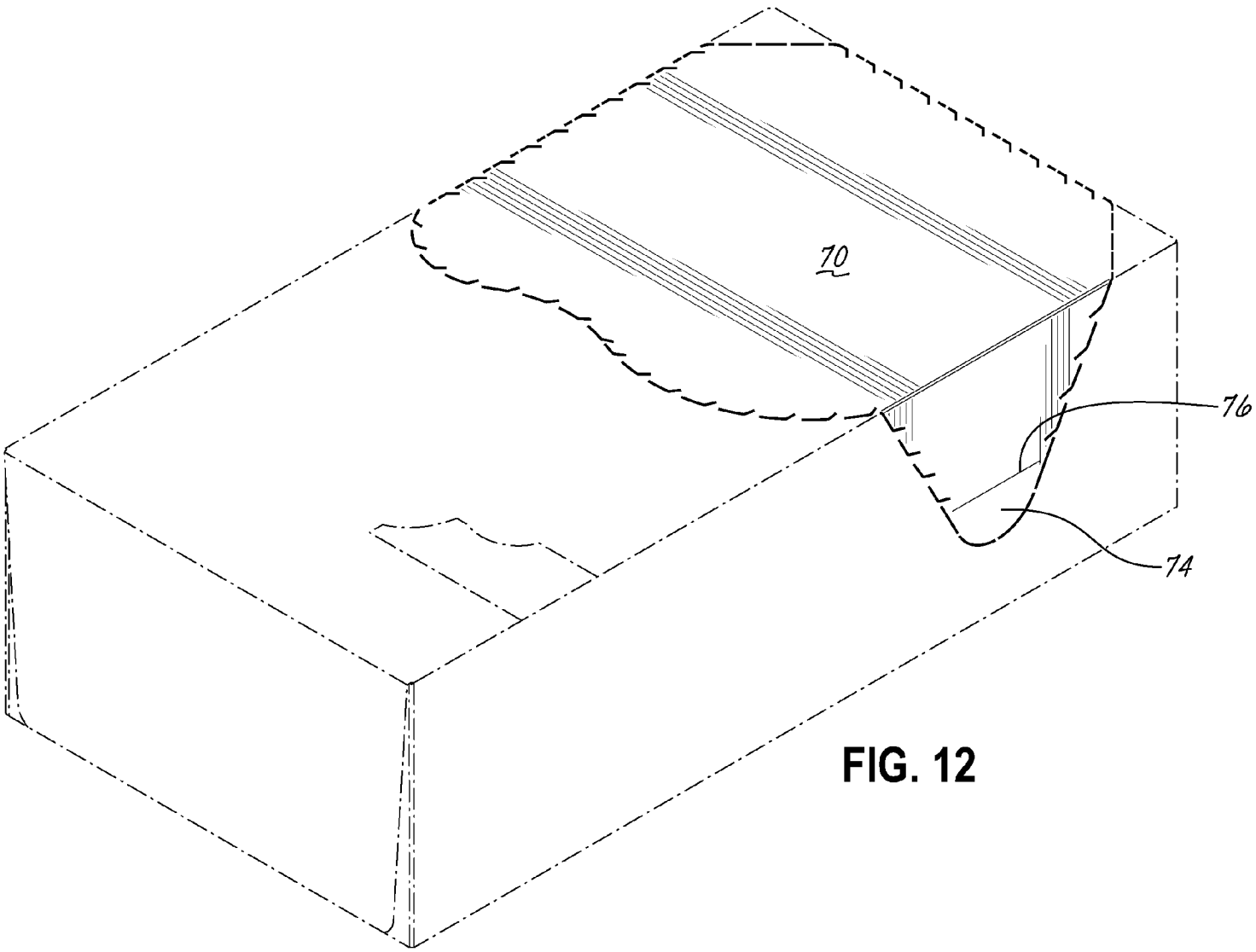
FIG. 12 is a perspective view of a dispenser flap according to another embodiment of this invention.
Figure 13:
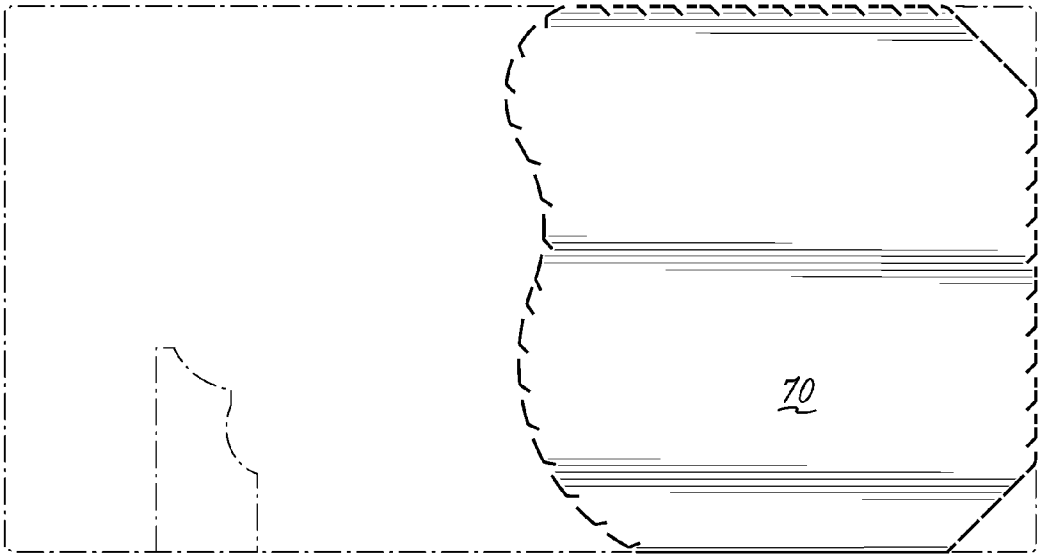
FIG. 13 is a top plan view of the dispenser flap of FIG. 12.
Figure 14:
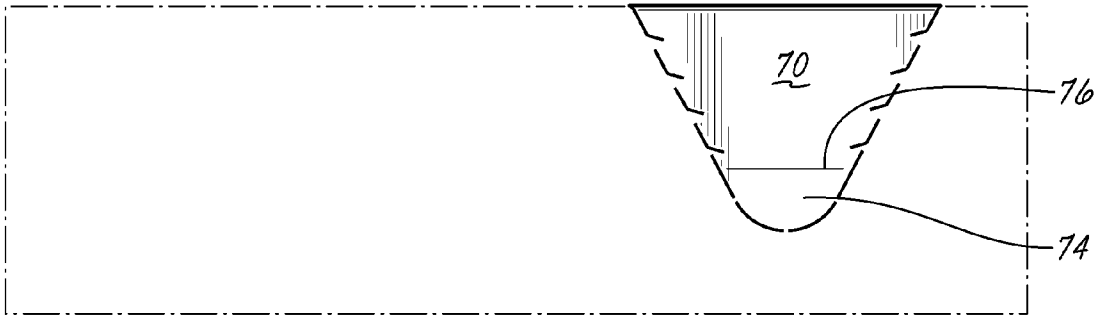
FIG. 14 is a side elevational view of the dispenser flap of FIGS. 12-13.
Figure 15:
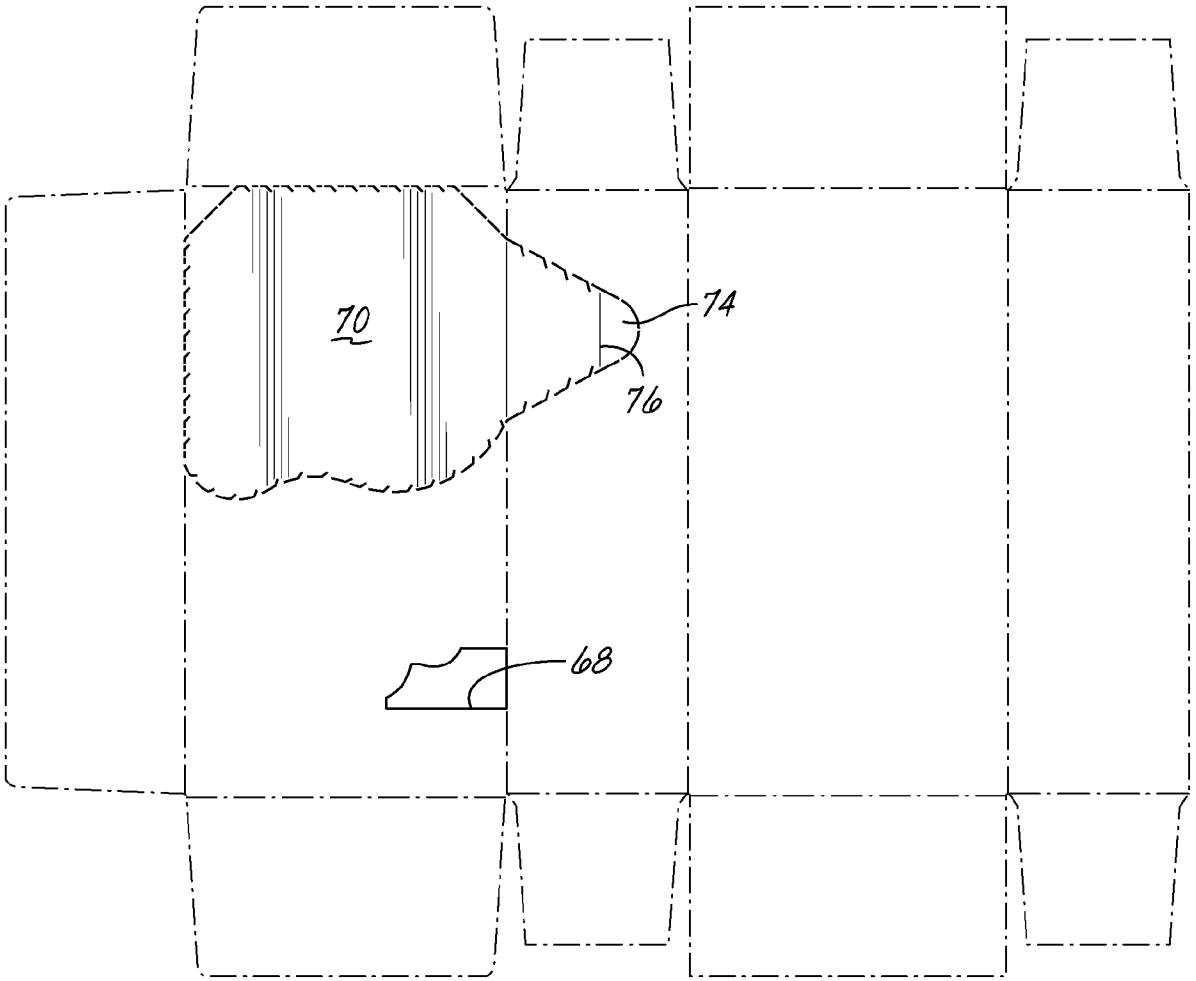
FIG. 15 is a top plan view of a dispenser flap and viewing window according to another embodiment of this invention.
Figure 16:
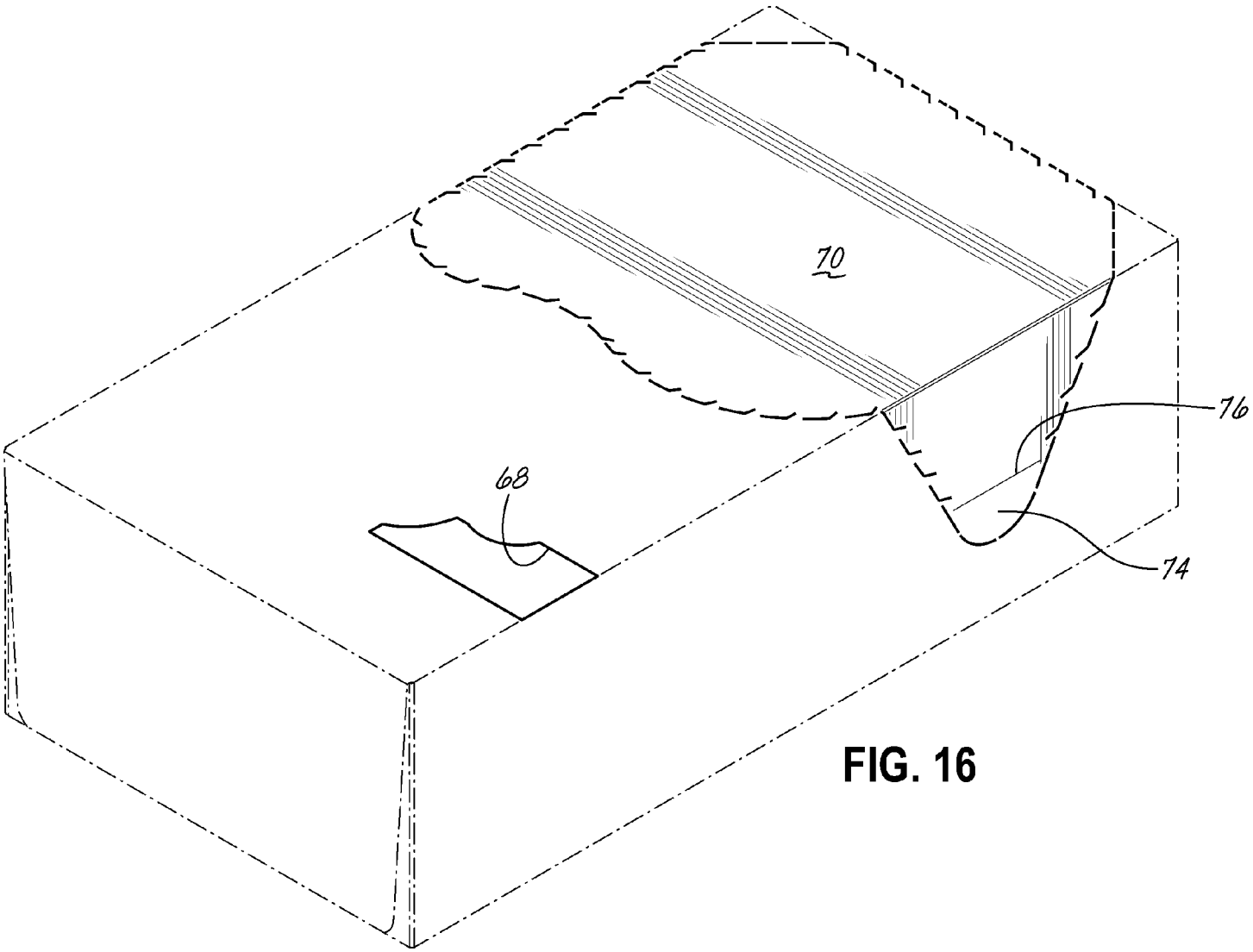
FIG. 16 is a perspective view of a dispenser flap and a viewing window according to another embodiment of this invention.
Figure 17:
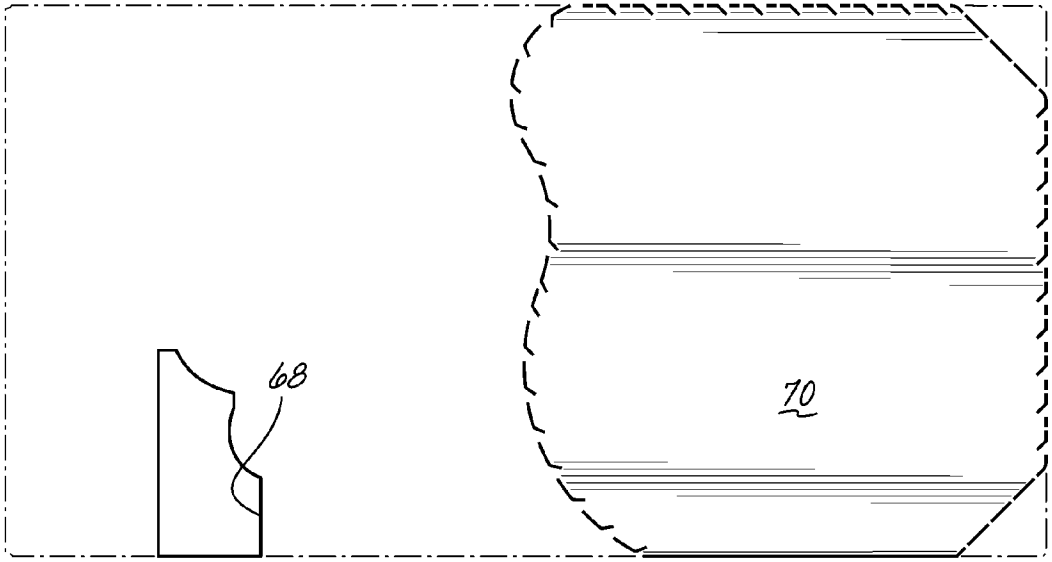
FIG. 17 is a top plan view of the embodiment of FIG. 16.
Figure 18:
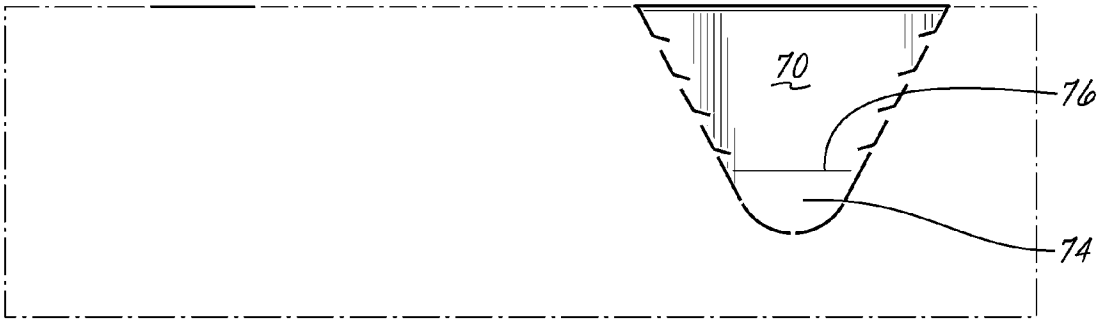
FIG. 18 is a side elevational view of the embodiment of FIGS. 16-17.
Figure 19:
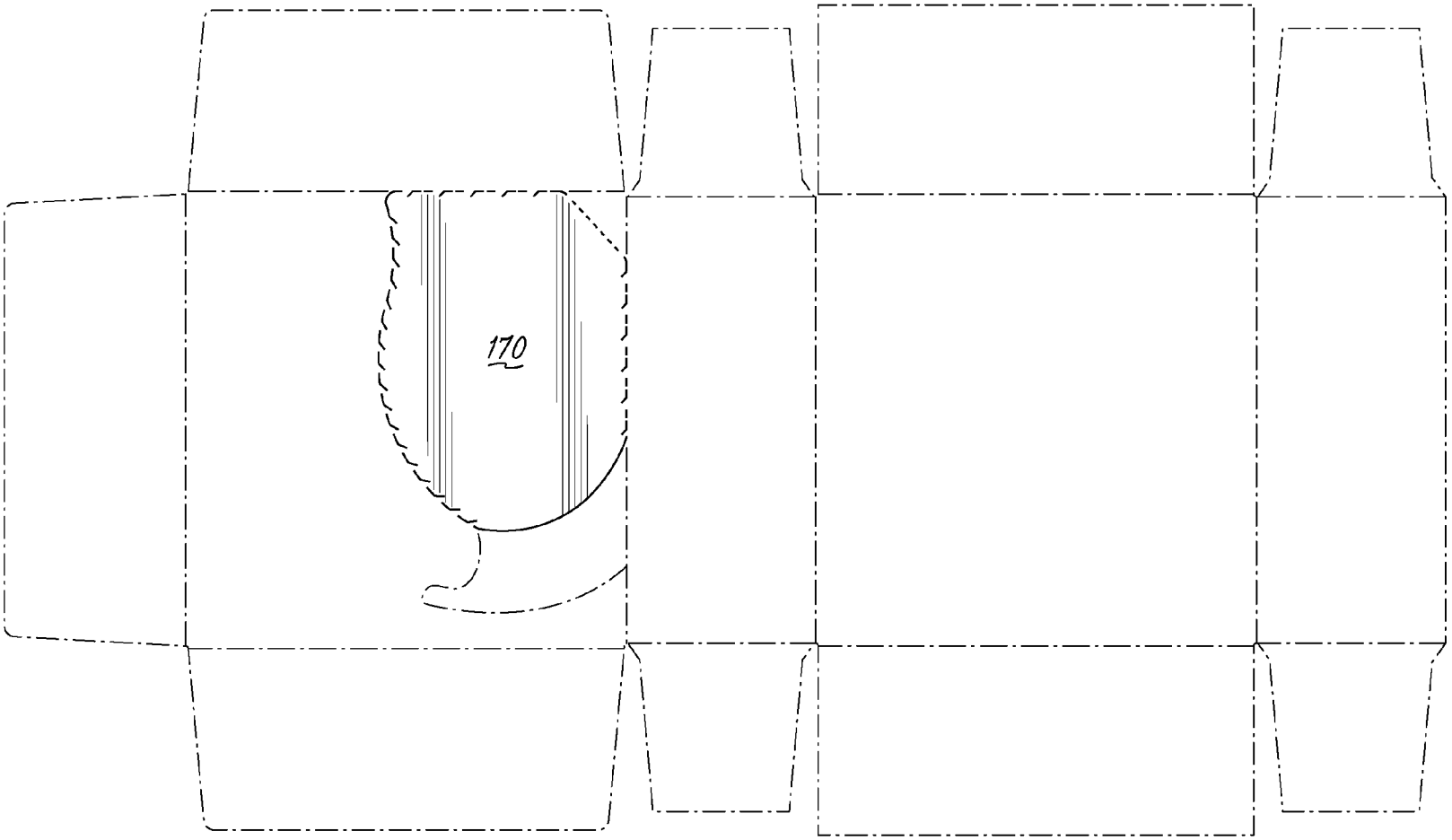
FIG. 19 is a top plan view of another embodiment of a dispenser flap according to another embodiment of this invention.
Figure 20:
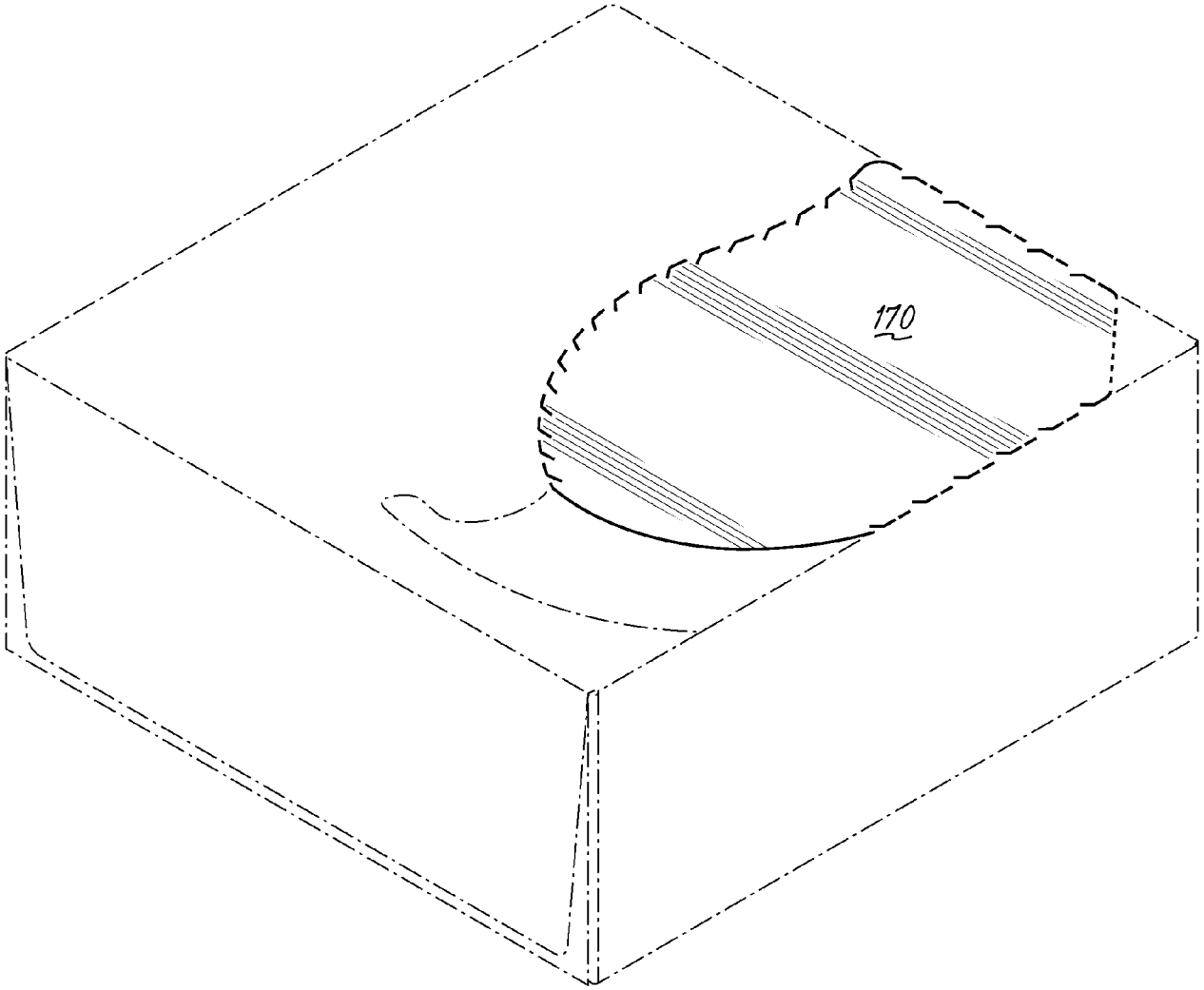
FIG. 20 is a perspective view of a dispenser flap according to another embodiment of this invention.
Figure 21:
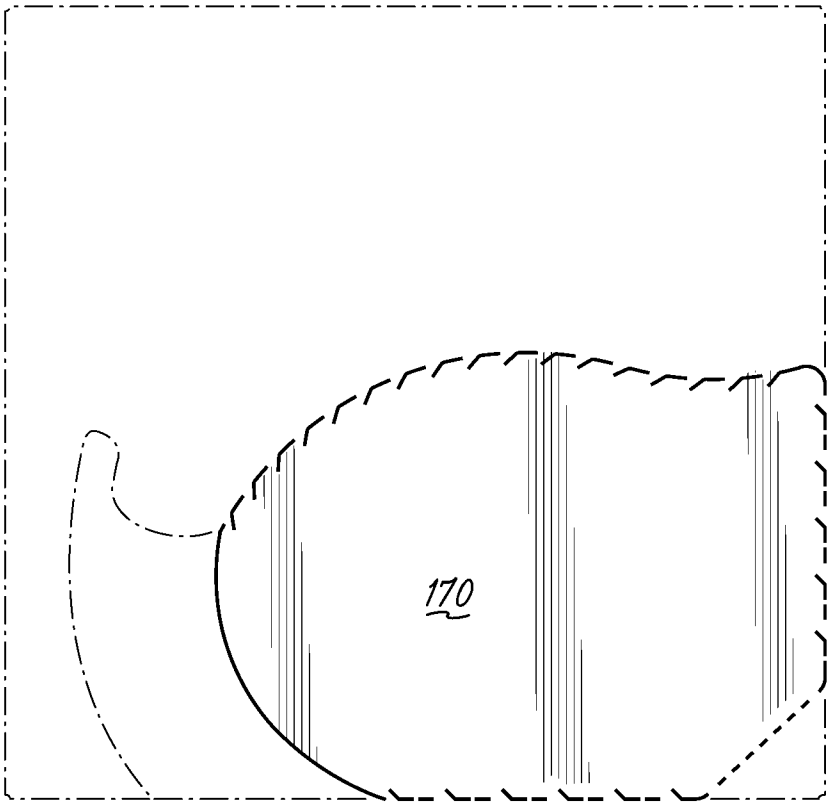
FIG. 21 is a top plan view of a dispenser flap according to another embodiment of this invention.
Figure 22:
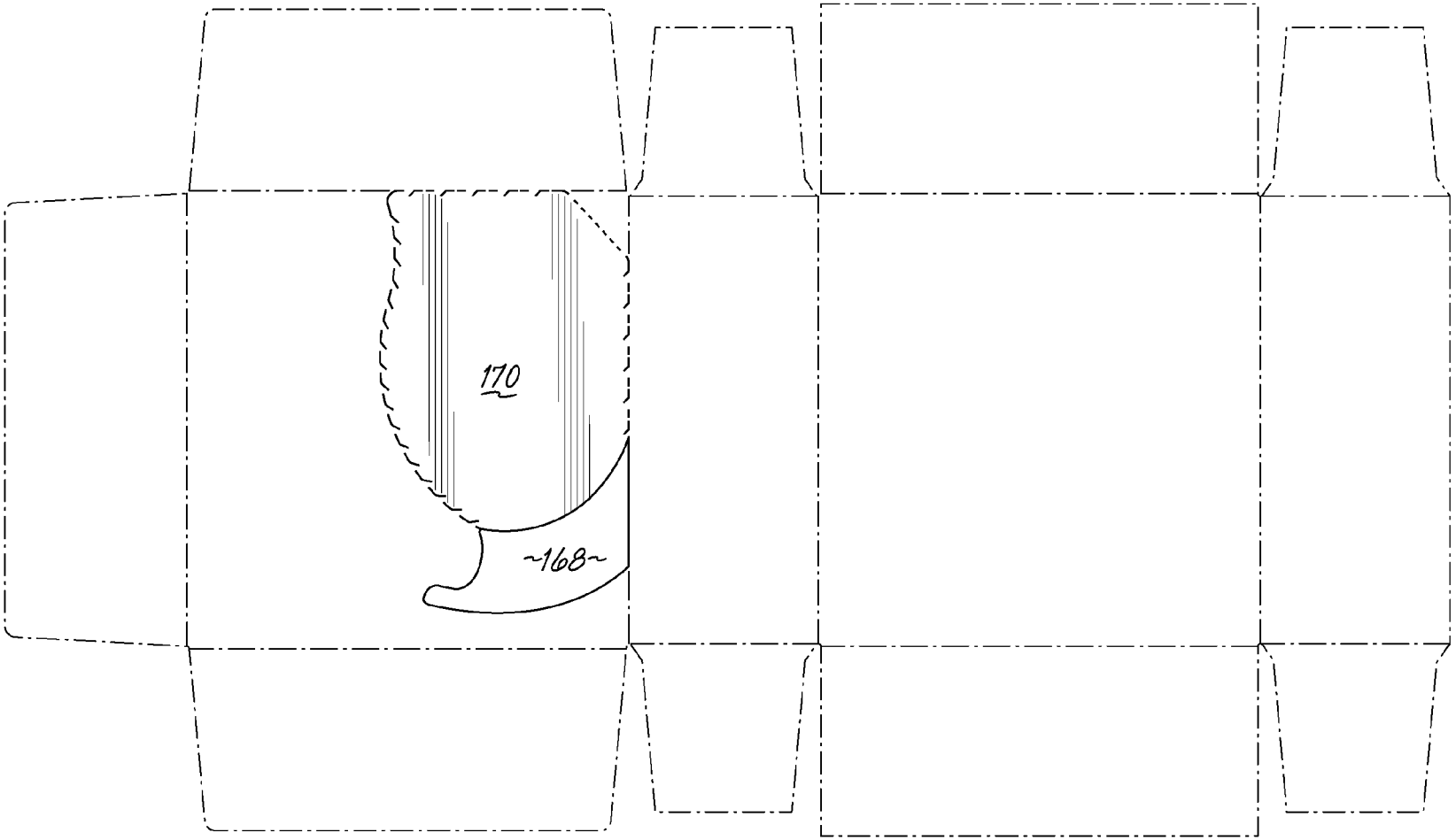
FIG. 22 is a top plan view of a dispenser flap and viewing window according to another embodiment of this invention.
Figure 23:
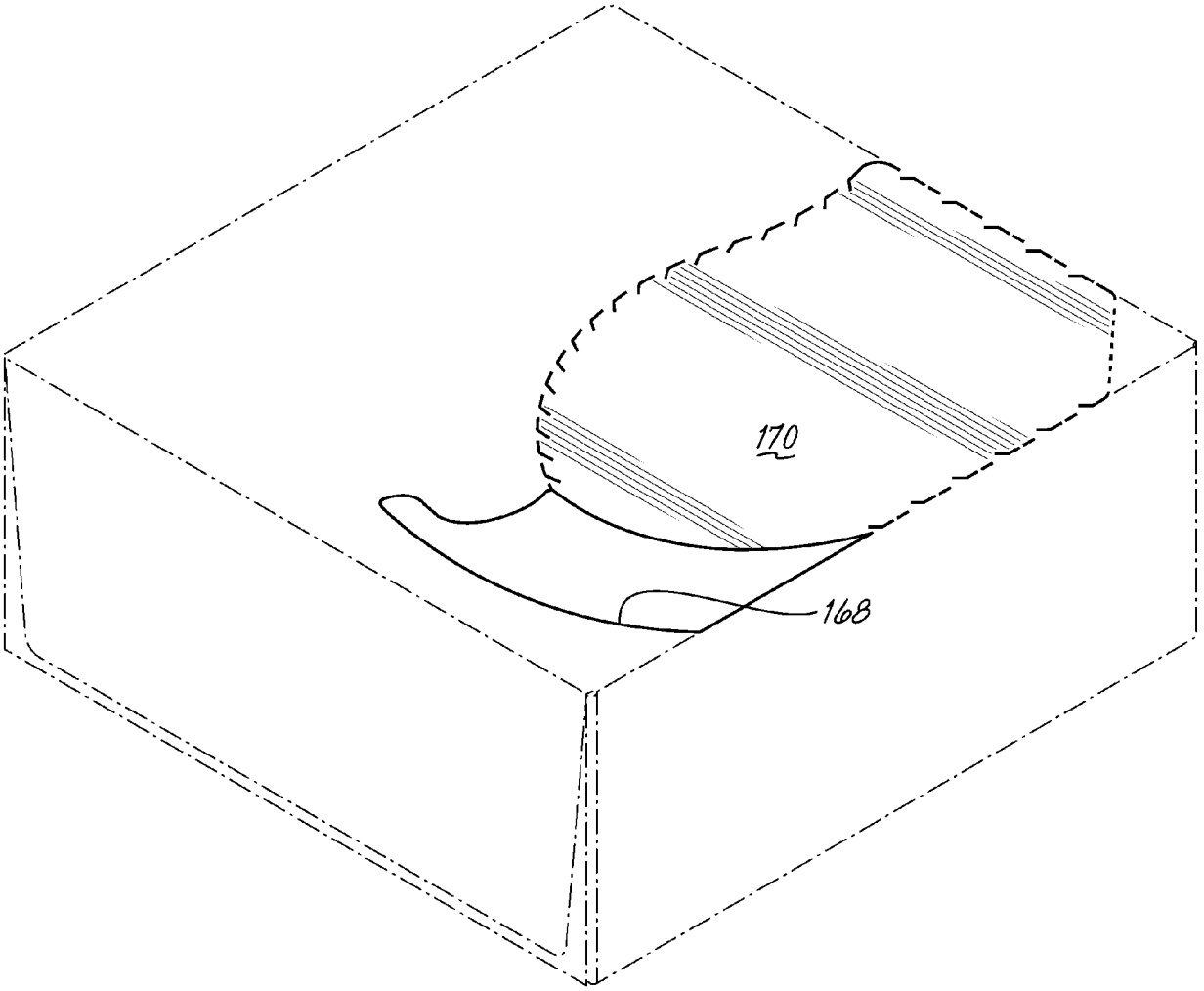
FIG. 23 is a perspective view of a dispenser flap and viewing window according to another embodiment of this invention.
Figure 24:
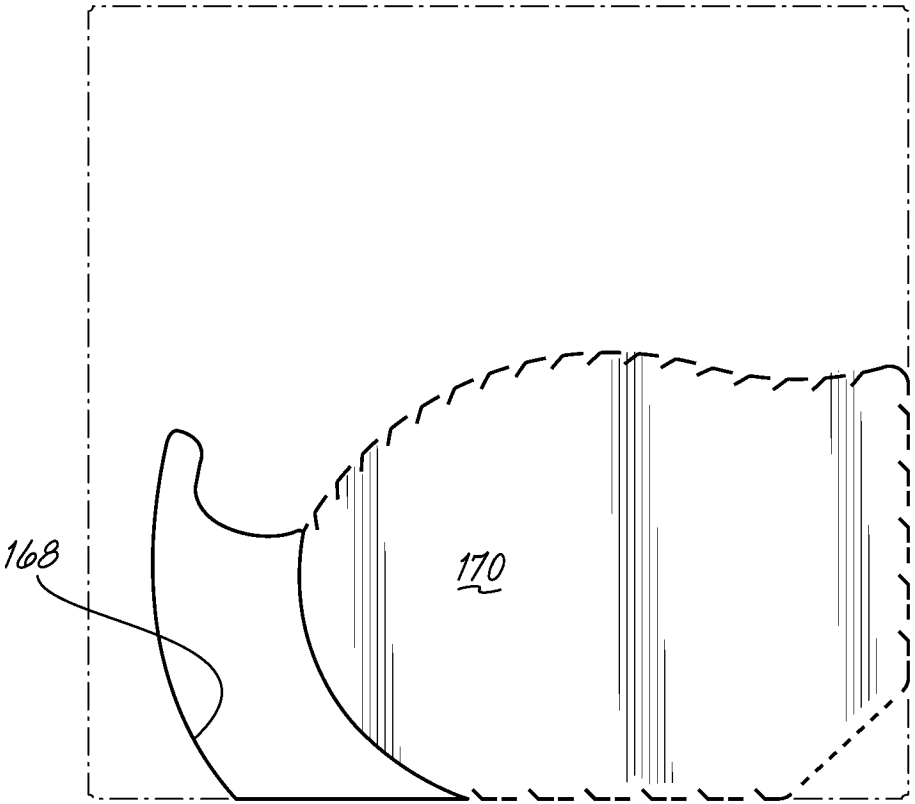
FIG. 24 is a top plan view of the dispenser flap and viewing window of the embodiment of FIG. 23.

Another embodiment of the carton blank no according to this invention is shown in FIG. 6 in which similar components of the embodiments of FIGS. 1-5 bear similar reference numerals in the 100 series of numbers. The dispenser 170 formed in the carton blank 110 of FIG. 6 is confined to the top panel 118 of the carton blank 110 and includes a single lobe 180 oriented along a generally longitudinal portion of the tear line 172 in the top panel 118. The dispenser 170 of the embodiment shown in FIG. 6 is contiguous with the viewing window 168 and a portion 170*a* of the dispenser 170 adjacent to the viewing window 168 may be grasped for removal of the dispenser 170 along the dispenser tear line 172 to thereby expose the dispenser opening 178 as shown in FIG. 8. The carton blank 110 of FIG. 6 may be utilized to form a package 114 containing four containers 116 or pouches similarly oriented in the carton 112 as shown in FIG. 10.

It will be appreciated by one of ordinary skill in the art that any number and/or arrangement of containers 16, 116 within the carton 12, 112 may be utilized within the scope of this invention. The containers 16, 116 according to some embodiments of this invention shown in FIGS. 1-10 are oriented with a longitudinal axis of each container 16, 116 generally parallel with the top 18, 118, bottom 20, 120 and composite end panels 44, 144, 46, 146 of the erected carton 12, 112, although other arrangements and orientations of the containers are possible within the scope of this invention. The containers 16, 116 may be layered and the orientation of the pouches in successive layers may alternate cap to bottom gusset. In other configurations according to this invention, the orientation of the containers 16, 116 from layer to layer may be the same, 90° offset, 180° offset or another arrangement. While the dispenser tear line 72, 172 is represented in the various drawings as including portions which include nicks or perforations, one of ordinary skill in the art will appreciate that many various types of tear lines may be utilized in combination or singularly to form the dispenser tear line 72, 172 compatible with this invention.

Another aspect of this invention is that the dispenser 70, 170 and associated tear line 72, 172 and resulting dispenser opening 78, 178 do not extend into the composite end panels 44, 144, 46, 146 of the erected carton 12, 112. This feature of various embodiments of the invention contributes to maintaining the structural integrity of the carton as well as the ease and removal of the dispenser from the carton.

FIGS. 11-24 show various views of various embodiments of this invention demonstrating the ornamental appearance of the dispenser and/or viewing window according to embodiments of this invention.

From the above disclosure of the general principles of this invention and the preceding detailed description of at least one embodiment, those skilled in the art will readily comprehend the various modifications to which this invention is susceptible. Therefore, we desire to be limited only by the scope of the following claims and equivalents thereof.

We claim:

1. A package comprising:

a plurality of similarly oriented containers each having a longitudinal axis;

a carton with the plurality of containers therein, the carton further comprising (a) a top panel spaced from a bottom panel, a first side panel spaced from a second side panel, and a first end panel spaced from a second end panel, wherein each of the first and second end panels are formed from a plurality of flaps extending from selected ones of the top, bottom and side panels;

(b) a first, a second, a third and a fourth top panel corner in the top panel, each top panel corner being formed at an intersection of the top panel, one of the side panels and one of the end panels; and (c) a dispenser defined at least in part by a dispenser tear line in the top panel, the dispenser defining at least in part a dispenser opening in the carton through which the containers may be removed from the carton through the top panel after the dispenser is removed along the dispenser tear line from the carton;

wherein the dispenser tear line extends at least partially along, is coincident and parallel with a first juncture between the top panel and the first side panel and at least partially along, coincident and parallel with a second juncture between the top panel and the first end panel;

wherein the dispenser and associated dispenser opening do not include the first, second, third or fourth top panel corners such that the carton retains structural integrity after the dispenser is removed from the carton.

2. The package of claim 1 wherein the first side panel is adjacent to the first end panel.

3. The package of claim 1 wherein the longitudinal axis of each container is oriented generally parallel to the top panel, bottom panel and each end panel of the carton.

4. The package of claim 1 wherein the dispenser is adjacent to at least one of the side panels and at least one of the end panels.

5. The package of claim 1 further comprising:

a viewing window in the top panel through which at least one of the containers in the carton may be viewed prior to removal of the dispenser from the carton.

6. The package of claim 5 wherein the viewing window is adjacent to and contiguous with the dispenser opening.

7. The package of claim 5 wherein the viewing window is spaced from the dispenser opening.

8. The package of claim 1 wherein the dispenser, dispenser opening and dispenser tear line each extend into the second side panel.

9. The package of claim 8 wherein the dispenser, dispenser opening and dispenser tear line are each confined to the top panel and the second side panel.

10. The package of claim 1 wherein the dispenser, dispenser opening and dispenser tear line are each confined to the top panel.

11. The package of claim 1 further comprising:

a finger flap adjacent to the dispenser tear line by which a user may tear the dispenser tear line, remove the dispenser and expose the dispenser opening.

12. A package comprising:

a plurality of similarly oriented pouches each having a longitudinal axis;

a carton with the plurality of pouches therein, the carton further comprising (a) a top panel spaced from a bottom panel, a first side panel spaced from a second side panel, and a first end panel spaced from a second end panel, wherein each of the first and second end panels are formed from a plurality of flaps extending from selected ones of the top, bottom and side panels;

wherein the longitudinal axis of each container is oriented generally parallel to the top panel, bottom panel and each end panel of the carton;

(b) a first, a second, a third and a fourth top panel corner in the top panel, each top panel corner being formed at an intersection of the top panel, one of the side panels and one of the end panels; and (c) a dispenser defined at least in part by a dispenser tear line in the top panel, the dispenser defining at least in part a dispenser opening in the carton through which the pouches may be removed from the carton through the top panel after the dispenser is removed along the dispenser tear line from the carton;

wherein the dispenser is adjacent to at least one of the side panels and at least one of the end panels and the dispenser tear line extends at least partially along, coincident and parallel with a first juncture between the top panel and the first side panel and at least partially along, coincident and parallel with a second juncture between the top panel and the first end panel;

wherein the dispenser and associated dispenser opening do not include the first, second, third or fourth top panel corners such that the carton retains structural integrity after the dispenser is removed from the carton.

13. The package of claim 12 further comprising:

a viewing window in the top panel through which at least one of the containers in the carton may be viewed prior to removal of the dispenser from the carton.

14. The package of claim 13 wherein the viewing window is adjacent to and contiguous with the dispenser opening.

15. The package of claim 13 wherein the viewing window is spaced from the dispenser opening.

16. The package of claim 12 wherein the dispenser, dispenser opening and dispenser tear line each extend into the second side panel.

17. The package of claim 16 wherein the dispenser, dispenser opening and dispenser tear line are each confined to the top panel and the second side panel.

18. The package of claim 12 wherein the dispenser, dispenser opening and dispenser tear line are each confined to the top panel.

19. The package of claim 12 further comprising:

a finger flap adjacent to the dispenser tear line by which a user may tear the dispenser tear line, remove the dispenser and expose the dispenser opening.

20. A carton for containing a plurality of similarly oriented containers each having a longitudinal axis, the carton comprising:

a top panel spaced from a bottom panel, a first side panel spaced from a second side panel, and a first end panel spaced from a second end panel, wherein each of the first and second end panels are formed from a plurality of flaps extending from selected ones of the top, bottom and side panels;

a first, a second, a third and a fourth top panel corner in the top panel, each top panel corner being formed at an intersection of the top panel, one of the side panels and one of the end panels; and a dispenser defined at least in part by a dispenser tear line in the top panel, the dispenser defining at least in part a dispenser opening in the carton through which the containers may be removed from the carton through the top panel after the dispenser is removed along the dispenser tear line from the carton;

wherein the dispenser tear line extends at least partially along, is coincident and parallel with a first juncture between the top panel and the first side panel and at least partially along, coincident and parallel with a second juncture between the top panel and the first end panel;

wherein the dispenser and associated dispenser opening do not include the first, second, third or fourth top panel corners such that the carton retains structural integrity after the dispenser is removed from the carton.

21. The carton of claim 20 wherein the dispenser is adjacent to at least one of the side panels and at least one of the end panels.

22. The carton of claim 20 further comprising:

a viewing window in the top panel through which at least one of the containers in the carton may be viewed prior to removal of the dispenser from the carton.

23. The carton of claim 22 wherein the viewing window is adjacent to and contiguous with the dispenser opening.

24. The carton of claim 22 wherein the viewing window is spaced from the dispenser opening.

25. The carton of claim 20 wherein the dispenser, dispenser opening and dispenser tear line each extend into the second side panel.

26. The carton of claim 20 wherein the dispenser, dispenser opening and dispenser tear line are each confined to the top panel and the second side panel.

27. The carton of claim 20 wherein the dispenser, dispenser opening and dispenser tear line are each confined to the top panel.

28. The carton of claim 20 further comprising:

a finger flap adjacent to the dispenser tear line by which a user may tear the dispenser tear line, remove the dispenser and expose the dispenser opening.

29. A carton for containing a plurality of similarly oriented containers each having a longitudinal axis, the carton comprising:

a top panel spaced from a bottom panel, a first side panel spaced from a second side panel, and a first end panel spaced from a second end panel, wherein each of the first and second end panels are formed from a plurality of flaps extending from selected ones of the top, bottom and side panels;

a first, a second, a third and a fourth top panel corner in the top panel, each top panel corner being formed at an intersection of the top panel, one of the side panels and one of the end panels; and a dispenser defined at least in part by a dispenser tear line in the top panel, the dispenser defining at least in part a dispenser opening in the carton through which the containers may be removed from the carton through the top panel after the dispenser is removed along the dispenser tear line from the carton;

wherein the dispenser tear line extends at least partially along, is coincident and parallel with a first juncture between the top panel and the first side panel and at least partially along, coincident and parallel with a second juncture between the top panel and the first end panel;

wherein the dispenser is adjacent to at least one of the side panels and at least one of the end panels;

wherein the dispenser and associated dispenser opening do not include the first, second, third or fourth top panel corners such that the carton retains structural integrity after the dispenser is removed from the carton.

30. The carton of claim 29 further comprising:

a viewing window in the top panel through which at least one of the containers in the carton may be viewed prior to removal of the dispenser from the carton.

31. The carton of claim 29 wherein the dispenser, dispenser opening and dispenser tear line are each confined to the top panel and the second side panel.

32. The carton of claim 29 wherein the dispenser, dispenser opening and dispenser tear line are each confined to the top panel.

33. A carton blank for forming into a carton adapted to contain a plurality of similarly oriented containers each having a longitudinal axis, the blank comprising:

a top panel, a bottom panel and a first and a second side panel serially joined together;

a plurality of end flaps each extending from selected ones of the top, bottom and side panels, a first set of the end flaps combining to form a first end panel of the carton erected from the carton blank and a second set of the end flaps combining to form a second end panel of the carton erected from the carton blank;

a first, a second, a third and a fourth top panel corner in the top panel, each top panel corner being formed at an intersection of the top panel, one of the side panels and one of the end panels in the carton erected from the carton blank; and a dispenser defined at least in part by a dispenser tear line in the top panel, the dispenser defining at least in part a dispenser opening in the carton through which the containers may be removed from the carton through the top panel after the dispenser is removed along the dispenser tear line from the carton erected from the carton blank;

wherein the dispenser tear line extends at least partially along, is coincident and parallel with a first juncture between the top panel and the first side panel and at least partially along, coincident and parallel with a second juncture between the top panel and the first end panel;

wherein the dispenser and associated dispenser opening do not include the first, second, third or fourth top panel corners such that the carton retains structural integrity after the dispenser is removed from the carton erected from the carton blank.

34. The blank of claim 33 wherein the dispenser is adjacent to at least one of the side panels and at least one of the end panels.

35. The blank of claim 33 further comprising:

a viewing window in the top panel through which at least one of the containers in the carton may be viewed prior to removal of the dispenser from the carton erected from the blank.

36. The blank of claim 35 wherein the viewing window is adjacent to and contiguous with the dispenser opening.

37. The blank of claim 35 wherein the viewing window is spaced from the dispenser opening.

38. The blank of claim 33 wherein the dispenser, dispenser opening and dispenser tear line each extend into the second side panel.

39. The blank of claim 33 wherein the dispenser, dispenser opening and dispenser tear line are each confined to the top panel and the second side panel.

40. The blank of claim 33 wherein the dispenser, dispenser opening and dispenser tear line are each confined to the top panel.

41. The blank of claim 33 further comprising:

a finger flap adjacent to the dispenser tear line by which a user may tear the dispenser tear line, remove the dispenser and expose the dispenser opening.

42. A carton blank for forming into a carton adapted to contain a plurality of similarly oriented containers each having a longitudinal axis, the blank comprising:

a top panel, a bottom panel and a first and a second side panel serially joined together;

a plurality of end flaps each extending from selected ones of the top, bottom and side panels, a first set of the end flaps combining to form a first end panel of the carton erected from the carton blank and a second set of the end flaps combining to form a second end panel of the carton erected from the carton blank;

a first, a second, a third and a fourth top panel corner in the top panel, each top panel corner being formed at an intersection of the top panel, one of the side panels and one of the end panels in the carton erected from the carton blank; and a dispenser defined at least in part by a dispenser tear line in the top panel, the dispenser defining at least in part a dispenser opening in the carton through which the containers may be removed from the carton through the top panel after the dispenser is removed along the dispenser tear line from the carton erected from the carton blank;

wherein the dispenser is adjacent to at least one of the side panels and at least one of the end panels;

wherein the dispenser and associated dispenser opening do not include the first, second, third or fourth top panel corners such that the carton retains structural integrity after the dispenser is removed from the carton erected from the carton blank;

wherein the dispenser tear line extends at least partially along, coincident and parallel with a first juncture between the top panel and the first side panel and at least partially along, coincident and parallel with a second juncture between the top panel and the first end panel.

43. The blank of claim 42 further comprising:

a viewing window in the top panel through which at least one of the containers in the carton may be viewed prior to removal of the dispenser from the carton erected from the blank.

44. The blank of claim 42 wherein the dispenser, dispenser opening and dispenser tear line each extend into the second side panel.

45. The blank of claim 42 wherein the dispenser, dispenser opening and dispenser tear line are each confined to the top panel and the first second side panel.

46. The blank of claim 42 wherein the dispenser, dispenser opening and dispenser tear line are each confined to the top panel.

47. The blank of claim 42 further comprising:

a finger flap adjacent to the dispenser tear line by which a user may tear the dispenser tear line, remove the dispenser and expose the dispenser opening.

* * * * *